US007198674B2

(12) United States Patent
Schaeuble

(10) Patent No.: US 7,198,674 B2
(45) Date of Patent: Apr. 3, 2007

(54) DEVICE FOR SURFACE COATING OF SMALL PARTS

(75) Inventor: Bernhard Schaeuble, Villingen-Schwenningen (DE)

(73) Assignee: Ernst Reinhardt GmbH (DE)

( * ) Notice: Subject to any disclaimer, the term of this patent is extended or adjusted under 35 U.S.C. 154(b) by 227 days.

(21) Appl. No.: 10/951,103

(22) Filed: Sep. 27, 2004

(65) Prior Publication Data

US 2005/0257739 A1 Nov. 24, 2005

(30) Foreign Application Priority Data

Sep. 25, 2003 (DE) ..... 103 44 475

(51) Int. Cl.
*B05C 3/00* (2006.01)

(52) U.S. Cl. ..... 118/418; 118/303; 118/56; 118/52

(58) Field of Classification Search ..... 118/418, 118/421, 19, 50, 52–56, 303; 427/242, 240; 69/30; 68/139; 204/199, 201, 212–214; 205/143, 145
See application file for complete search history.

(56) References Cited

U.S. PATENT DOCUMENTS

2003/0168005 A1* 9/2003 Reinhardt ..... 118/70

FOREIGN PATENT DOCUMENTS

| | | | |
|---|---|---|---|
| DE | 31 47 498 A | * | 9/1983 |
| DE | 34 20 859 C | * | 5/1986 |
| DE | 39 14 258 C | * | 5/1990 |
| DE | 196 13 927 C | * | 11/1997 |
| DE | 102 09 908 C | * | 8/2003 |
| GB | 769 553 A | * | 3/1957 |

* cited by examiner

*Primary Examiner*—Brenda A. Lamb
(74) *Attorney, Agent, or Firm*—Akerman Senterfitt; Peter A. Chiabotti

(57) ABSTRACT

The invention concerns a coating drum (60) for a single drum or, as the case may be, a multi-drum circulating coating device. The inside of the drum is subdivided into two rotation-symmetrical drum chambers (61 and 62) via a separating wall (67), which chambers are fillable with equal dispensed amounts of small parts through oppositely lying openings (73) of the drum casing (63). The openings (73) are closeable via lids or covers (68) provided pivotable on the drum (60).

15 Claims, 10 Drawing Sheets

DEVICE FOR SURFACE COATING OF SMALL PARTS

BACKGROUND OF THE INVENTION

1. Field of the Invention

The invention concerns a drum coating arrangement for surface coating of small parts.

2. Description of the Related Art

Various devices for surface coating are known. The coating of small parts takes place in a device with a rotating drum which, for receiving coating material, is either dunked into a coating basin (see DE 196 13 927 and DE 102 09 908 C1) or has coating material sprayed in (see DE 34 20 859 C2).

After completion of coating, the coating drum is caused to rotate rapidly, in order by means of centrifugal force to throw off excess coating material and to evenly distribute the coating on the surface of the small parts.

The maximum fill capacity of the coating drum is limited by two criteria.

On the one hand, in the case of greater fill volumes there is the danger that the small parts become unevenly distributed within the drum, which results in an imbalance during the spin process, which can be controlled only with difficulty if at all.

On the other hand, the drum is to be so dimensioned that the height through which the small particles are dropped during coating as well as during emptying of the drum (hereafter referred to as drop height) can be kept as small as possible.

These conditions lead to a reduction in the drum diameter, and therewith, the volume of the small parts to be coated.

SUMMARY OF THE INVENTION

The present invention is concerned with the task of providing a device with a drum, which is better at satisfying the mentioned conditions, and beyond this makes possible a greater through-put with smaller sized equipment.

The solution to this task is provided by a device in which a drum comprising a hollow cylinder with horizontally oriented drum axis is subdivided into two equally dimensioned rotationally-symmetric chambers, which can be supplied with the small parts through openings on opposite sides of the drum, arranged symmetrically relative to the drum axis, and which are closeable via lids or covers provided pivotable on the drum.

By the subdivision of the drum into two symmetrical drum chambers a more even filling of the drum is made possible, whereby above all in the case of larger fill volumes imbalances can be avoided.

Besides this, using the openings provided on the drum casing these drum chambers can be filled or emptied at smaller angular positions of these drums, so that the small parts to be introduced or removed in the form of flowable material are subjected to only a very small drop height.

The openings of the drum casing can be closeable with lids, which are provided pivotable preferably between the drum lids.

In one embodiment, the separating wall can be comprised of two radial segments provided diametrically opposed to each other on both sides of the drum axis, to which are connected curved segments which extend up to the drum casing. The lid herein likewise has a bow-shaped segment, which corresponds to the separating wall curved segment which extends up to the drum casing, and in the case that the lid is in the open position, lies against the outer side thereof. The curved segment of the lid is herein so dimensioned, that in the closed position of the lid the lid closes the opening of the drum.

A lid controllable simply and with little force is provided, according to which the curved segment of the lid is carried on both sides by two circular segment shaped side parts, which are mounted pivotably to the drum lid, wherein the pivot axis of the lid runs parallel to the drum axis and close to the outer circumference of the drum.

In one embodiment, the pivot axle can be connected fixed against rotation with the lid, so that a pivot lever lying outside the drum lid can be connected therewith fixed against rotation, whereby the lid, during rotation of the drum in the one or other direction, can be closed or, as the case may be, opened. For this purpose there is to be provided essentially a slideable slide valve, upon which the pivot lever runs during rotation of the drum.

The lids close automatically during rotation of the drum under the influence of centrifugal force. In order to securely maintain the lid in either the open or closed position a spring can be provided between the pivot lever and drum lid, wherein the pivot lever and pressure spring are in the form of an elbow lever or toggle lever.

In another arrangement, the lid can be provided with a slide extending over the breadth thereof, which gently conveys the small parts during filling or, as the case may be, emptying, of the drum chamber with small drop height.

The precise filling of the drum, which is divided into two parts in accordance with invention, is important, since filling of uneven amounts in the drum chambers can have undesired consequences.

For this purpose, a supply and metering device is provided, in which each of the two drum chambers is respectively associated with a supply chute, which is slideable on a support and guide rail or track parallel to the drum axis. This supply and metering device is associated with a weighing and filling station, in which the two supply chutes are filled with precisely metered, equal amounts of small parts.

The drum proposed in accordance with the invention is thus suited for a compactly constructed facility, in which the drum can be moved via a transport pusher between only two stations.

The first station serves herein for the filling or as the case may be emptying of the drum, while the second station, which includes a coating basin which can be lifted up against the drum, serves both for coating as well as for centrifuging of the small parts located in the drum.

The subcomponents necessary for this type of facility, such as rotational drive means, spray protection cover, collection pallets and supply containers for the coating material are provided.

The same coating drum is however suited also for a multi-drum circulating coating facility, as is described in detail in DE 102 09 908 C1.

For this, a number of inventive coating drums is provided, which are transportable to sequential stations by means of a conveyor:

- supply station for filling the drums;
- coating station, in which the circulating drum is dipped into a coating bath;
- drip station, in which excess coating material is allowed to drip, while slowly rotating the drum, and caught in a basin;
- slinging station, in which the drum is brought into a more rapid rotation, whereby an evening out of the distribution of coating occurs, and remaining excess coating material is spun off, as well as emptying station, in which the drum is emptied at slow rotation speed.

According to Claim 15 there is provided, as described in the above mentioned patent, a transport device for the return of the empty drums.

BRIEF DESCRIPTION OF THE DRAWINGS

The subject matter of the invention is described in the following in greater detail on the basis of the illustrative embodiments which are presented, in part schematically, in the figures. The figures show FIG. 1 perspective representation of a single drum coating facility with inventive coating drum, FIG. 2 schematic longitudinal section of the device along lines II—II in FIG. 4, FIG. 3 schematic top view of the device according to FIG. 2, FIG. 4 schematic right view of the device according to FIGS. 2 and 3, FIG. 5 schematic longitudinal section of a multi-drum circulation facility along the line V—V in FIG. 7, FIG. 6 top view of the facility according to FIG. 5, FIG. 7 left view of the facility according to FIGS. 5 and 6, FIG. 8 perspective representation of an inventive coating drum, lid closed, FIG. 9 perspective representation of the inventive coating drum omitting one of the two drum lids, FIG. 10 radial section of the drum according to FIGS. 8 and 9, FIG. 11 side view of the drum according to FIG. 10, FIG. 12 perspective representation of the drum according to FIG. 8, however with opened lid and schematic representation of a control slide (valve), FIG. 13 side view of the drum according to FIG. 12 with dashed dot indicated lid and FIG. 14 radial section of the drum with supply chute and catch pallet for representation of the material flow.

DETAILED DESCRIPTION OF THE INVENTION

Figure 1:
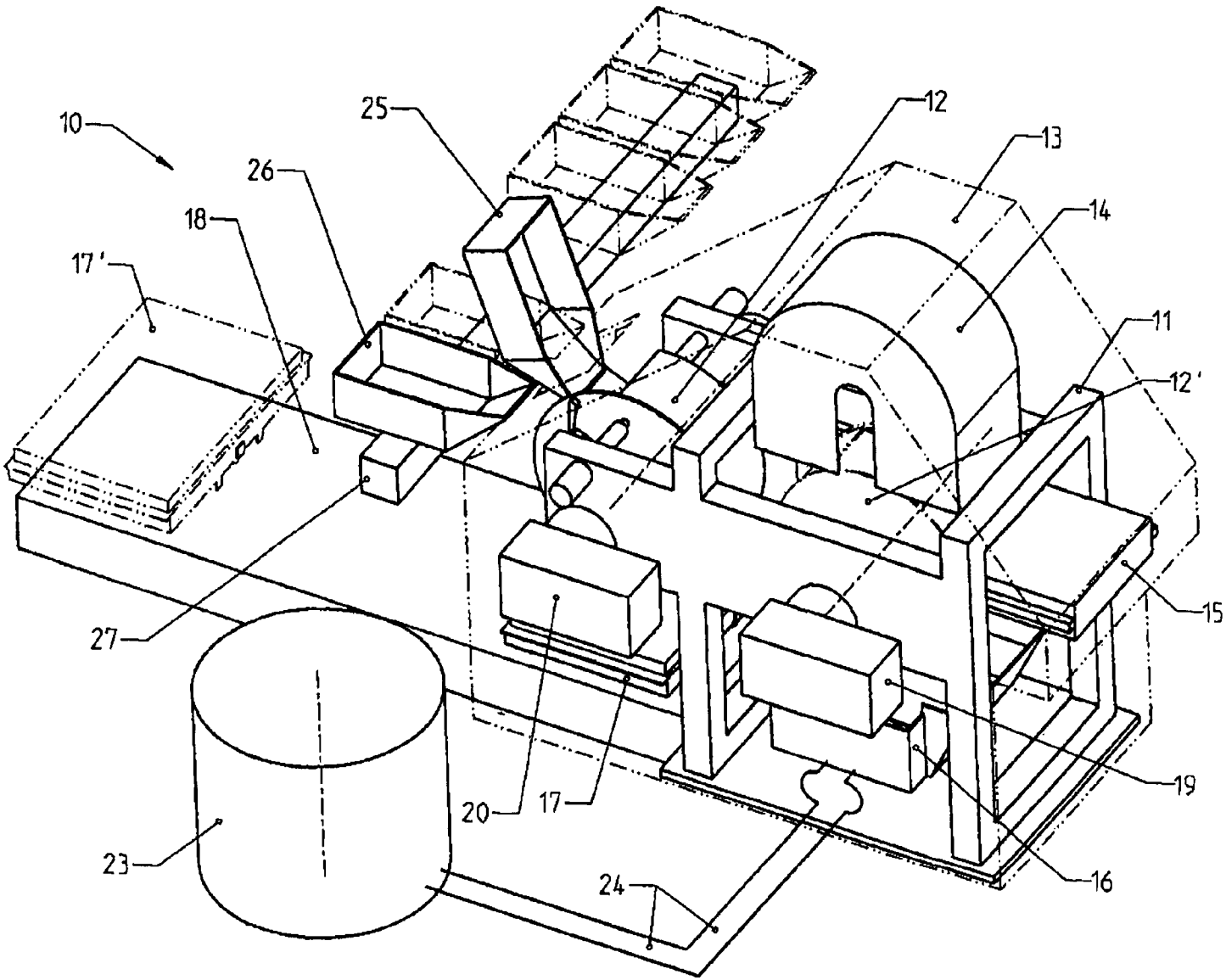
Figure 2:
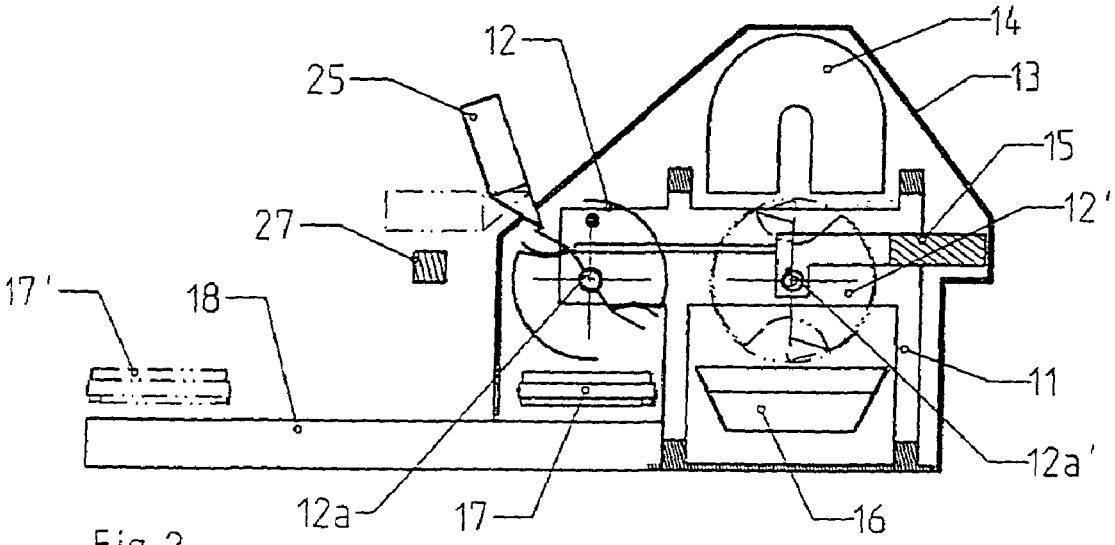

For illustrating the possibilities of employment and the manner of operation of the inventive drum there is first shown on the basis of FIGS. 1 through 7 two coating facilities in which the drum can be employed in advantageous manner.

The precise construction of the inventive drum is then explained on the basis of FIGS. 8 through 14.

A very compact single drum coating device 10 includes a machine stand 11, upon which a transversely (to the drum axis) slideable coating drum 12 is provided. This coating drum 12 is supported freely rotatable in a drum transport slider 15, with which the drum 12 can be moved from a fill-and-empty station into a coating station indicated with 12'. In order to bring the coating drum 12 or, as the case may be 12', into rotation, drive motors 19, 20, located on the machine stand 11, are provided engageable with the drum 12*a* or, as the case may be, 12*a*', via press devices 21 and 22 provided on the side opposite to the motors. For transport of the drum 12 into the position 12' and the reverse, the drive and press devices 20, 22 or as the case may be 19, 21 are moved axially apart, so that the drum is freely moveable in the transverse direction.

In the filling station, in which the drum 12 is located, there are provided filling chutes 25, 26 which are diagonally (to the machine stand) displaceable on a carrier and guide rail 27 in the positions indicated with dash-dot lines. Respectively one of the two chutes 25 and 26 is, as explained in the following on the basis of FIGS. 8 through 14, associated with one of the two drum chambers.

Figure 3:
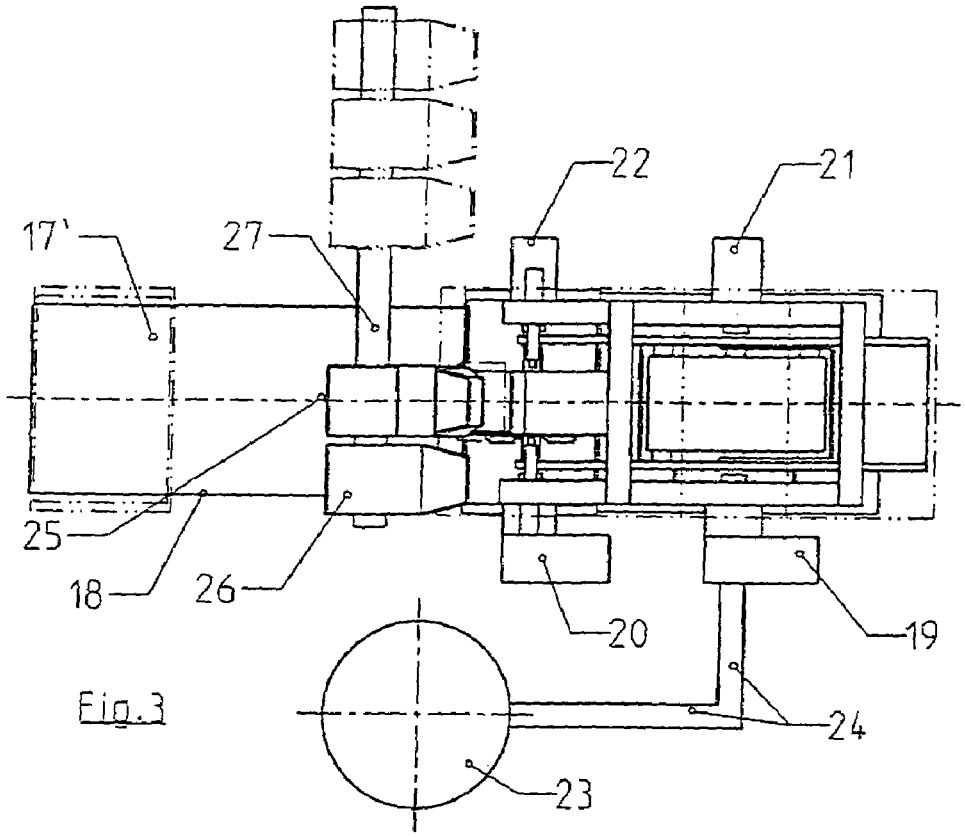
Figure 4:
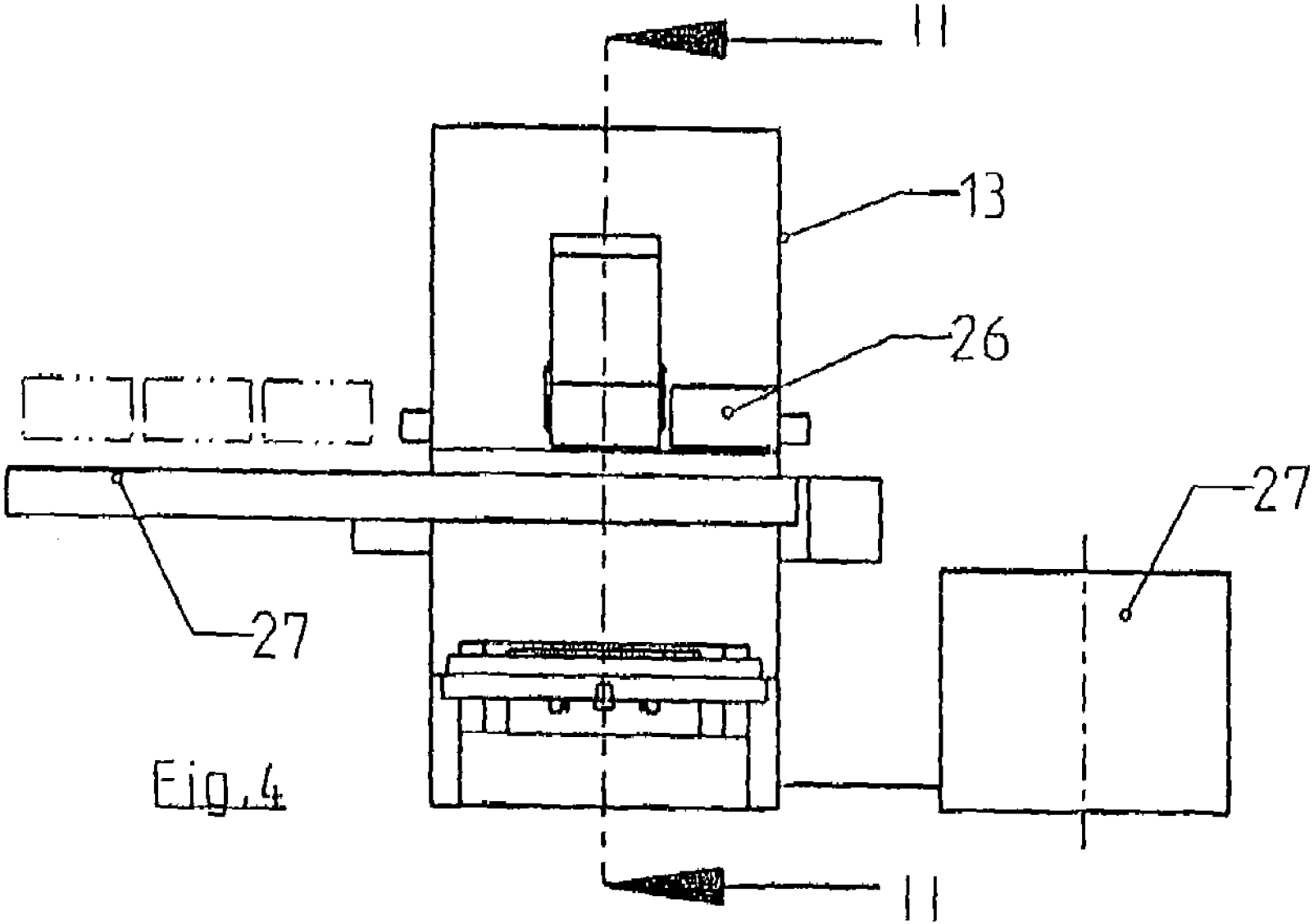

The filling of the supply chutes with the identical measured amounts of small parts occurs in the positions indicated with dash dot lines in FIGS. 3 and 4. After filling the drum chambers the drum 12 is moved to position 12', wherein in the following explained manner the drum openings are closed.

Below the drum 12' in the coating station there is a coating basin 16, which for the purpose of coating is lifted against the slowly rotating revolving drum 12'. The drum wall, preferably the drum casing, is perforated, so that coating material can enter into the inside of the drum and thereby wet with coating material the small parts located in the inside of the drum. The coating basin 16 is in communication with the supply container 23 via connecting hoses 24, so that by means of a level regulator it can be ensured that a sufficient amount of the coating material is in the coating basin 16.

After completion of coating the coating basin 16 is lowered and the drum 12' is first caused to rotate slowly, so that excess coating material can drip off. Thereupon there occurs a rapid rotation of the drum 12', whereby, under the influence of centrifugal force, on the one hand an evening out of the coating is accomplished and, on the other hand, excess coating material is spun off. Therein the spray cover 14 located above the coating drum 12' is lowered, so that the spun-off coating material does not reach the housing 13 covering over the entire device.

Before return transport of the drum out of position 12' by means of the drum transport pusher 15 into the position of the drum 12 the spray cover 14 must again be raised into the upper position shown in the figures.

In position 12 the lids are opened during slow rotation, so that the coated small parts can fall onto collection pallet 17 located below the drum 12.

By means of a pallet conveyor 18 the pallet 17 is moved to the position 17' indicated with dash-dot lines, in order to be transported from there for follow-up treatment to an oven or other drying equipment. Despite a quite large drum volume, the single drum coating facility according to the FIGS. 1 through 4 is of compact construction. Preferably the device, with the exception of two openings for filling and emptying, is completely enclosed by means of the housing 13. Also, the opening in the area of the fill chute 25, 26 or, as the case may be, the capture pallet 17 can be equipped with lids, whereby an air exchange with the environmental air and therewith emission of solvent of the coating material can substantially be avoided.

However the cycle time for coating in this compact device is reduced by the fact that in the one position the coating drum 12 is filled and emptied and in the other position 12' it is subject to coating and centrifuging.

Figure 5:
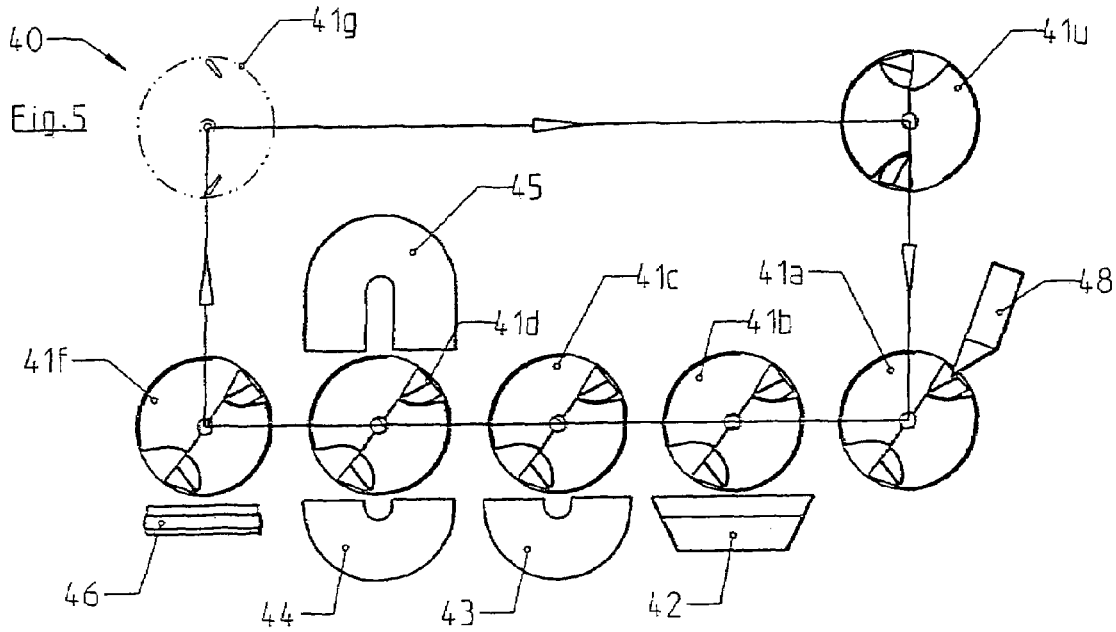
Figure 6:
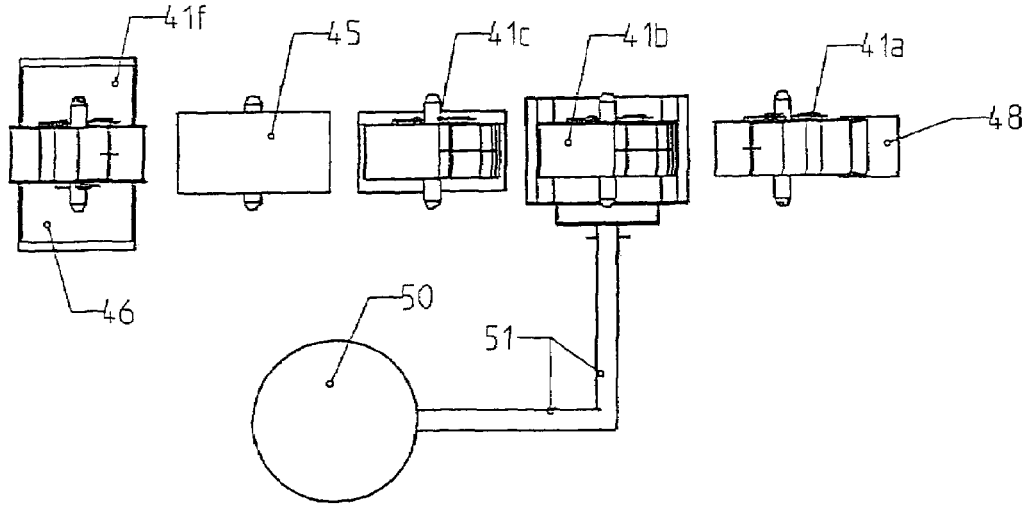
Figure 7:
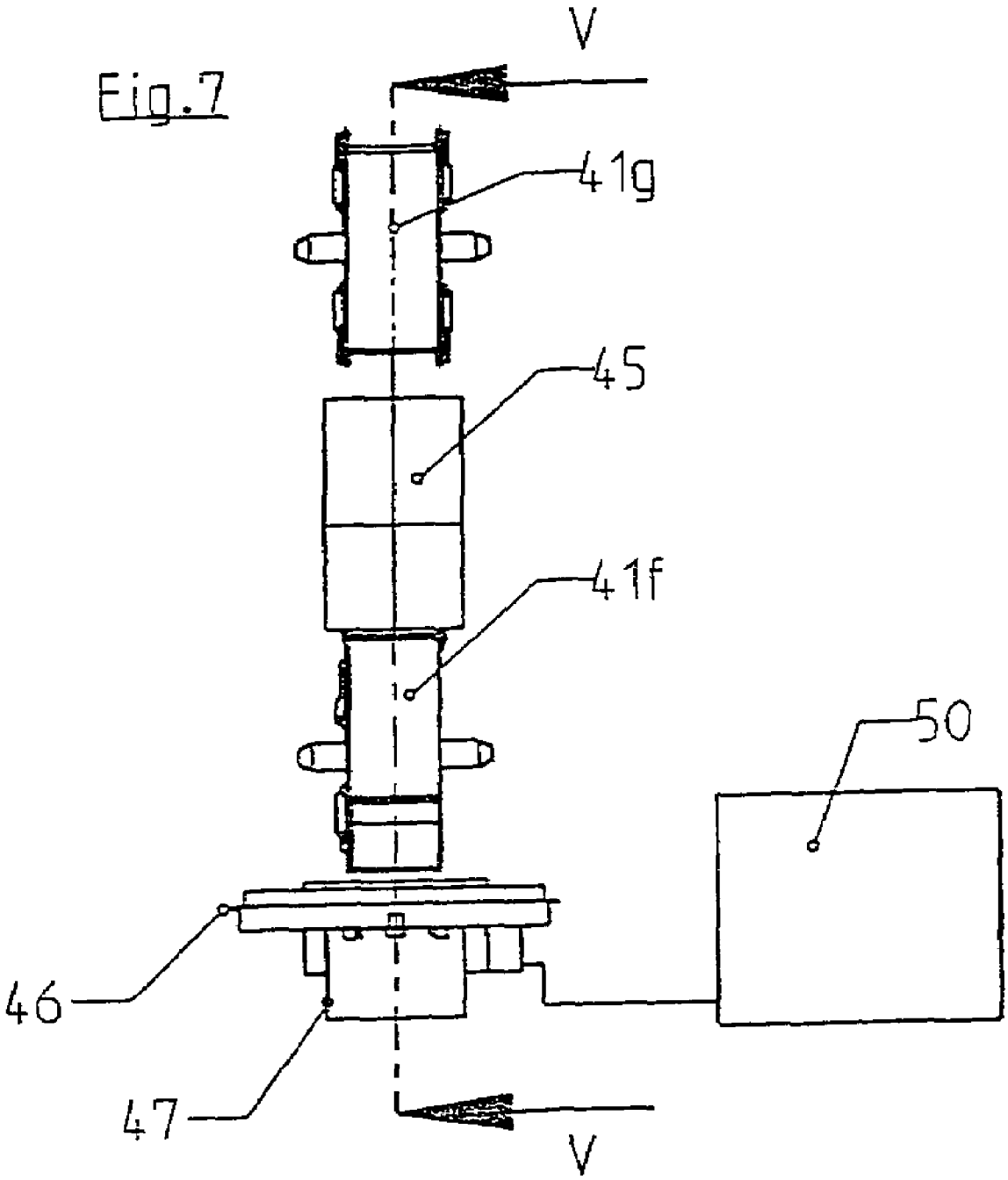

In the case that shorter cycle times are required, then a multi-drum circulation coating facility is recommended, as shown schematically in FIGS. 5 through 7 and as described in detail in DE 34 20 859 C2.

In this facility a number of coating drums 41*a* through 41*n* is provided, wherein the various processing steps are carried out sequentially in different stations.

The two chambers of the drum 41*a* are filled with small parts in the above described manner via chutes 48. By means of a not shown lifting bar transport device the drums are further transported into position 41*b* and dipped into coating basin 22 with slow rotation.

In position 41*c* the excess material drips with slow rotation. The material is caught in a drip basin 43.

In position 41*d* the rotation speed of the coating drum is accelerated, so that excess coating material is spun off under the influence of the centrifugal force and captured by means of lower and upper spray covers 44, 45 surrounding the drum 41*d*.

In position 41*f* the drum lids are opened, so that the coated material can exit the drum from below during slow rotation of the drum and be collected on a pallet 46.

The emptied drums are returned via positions 41*g* through 41*n* back to the starting position.

The essential element of both devices and the subject of the present invention is the coating drum 41 of which the details are shown in FIGS. 8 through 14. The coating drum 60 has the shape of a hollow cylinder, which is comprised of a drum casing 63 and drum lids 64, 65 on both sides. Drum lids 64, 65 and/or drum casing 63 are perforated, in order to allow entry of coating material into the inside of the drum.

For driving and transporting the drum 60 a drive and transport axle 66 is provided, which extends through the inside of the drum and extends out on both sides beyond the drum lid 64 and 65.

The inside of the drum is divided by means of a separating wall 67 into two equal-sized, rotational-symmetrical drum chambers 61 and 62. The separating wall is comprised of two diagonal segments 67*a* (radial segments) provided diametrically to each other on both sides of the drive and transport axis 66 and, connected thereto, curved segments 67*b* extending to the drum casing 63.

The drum casing 63 is interrupted by two openings 73 located on opposite sides. These openings 73 are provided with lids pivotable about axis S indicated with dash-dot lines, so they can be pivoted out of the upper opened position shown in FIG. 9 into the lower shown closed position.

On both sides of each lid 68 is circle-segment shaped (pie shaped) sheet metal 68*a* which are connected to each other via the curved segment 68*b*, with which the drum opening 73 is closeable. In the open position the bow segment 68*b* lies near the outer side of the curved segment 67*b* of the separating wall 67. In the closed position this curved segment 68*b* compliments the curved segment 67*b* to a complete closing of the opening 73. On the lid 68 there is provided a slide 68*c* to assist with filling and emptying, of which the manner of functioning is explained in greater detail in association with FIG. 14.

Figure 8:
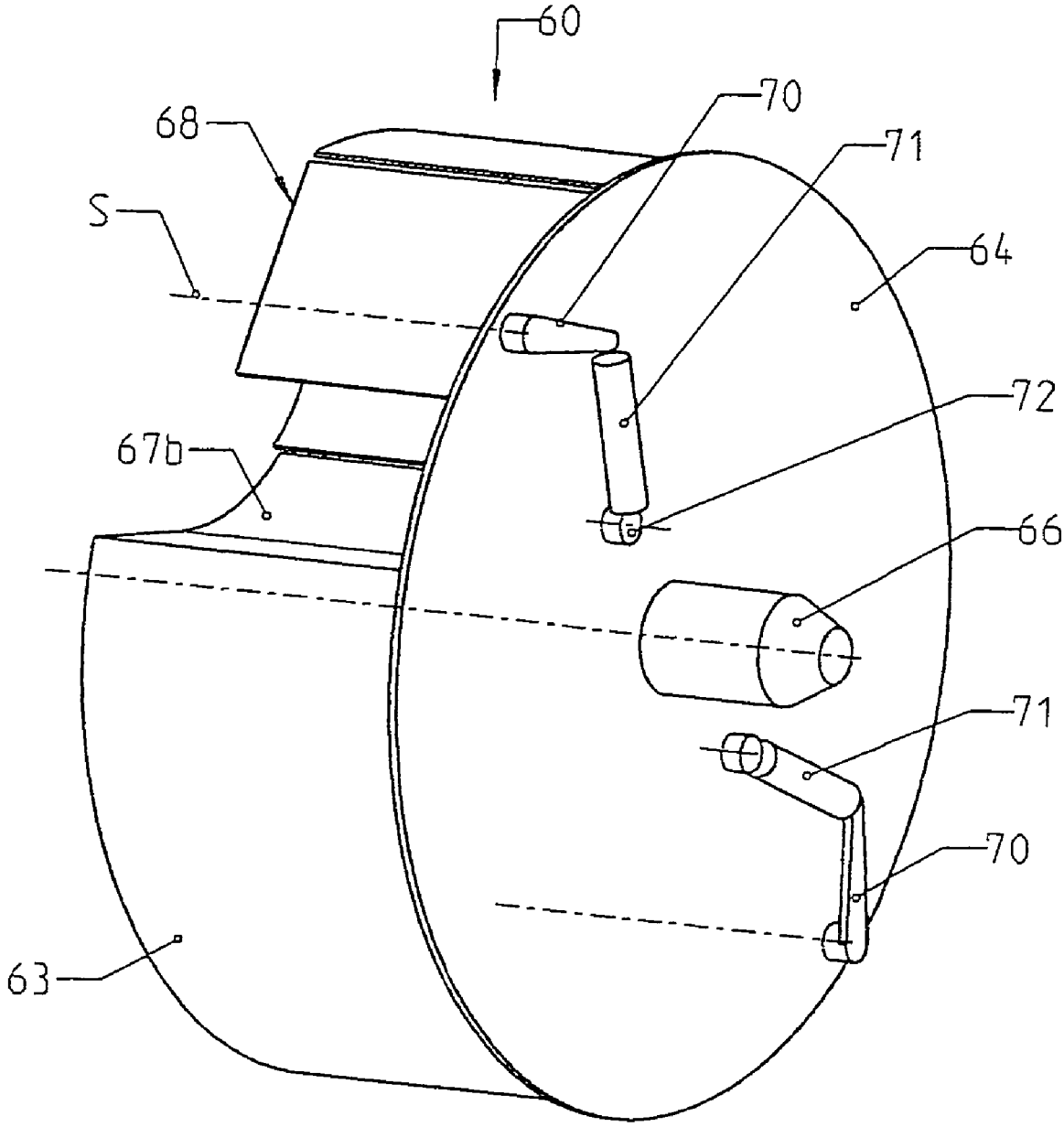
Figure 9:
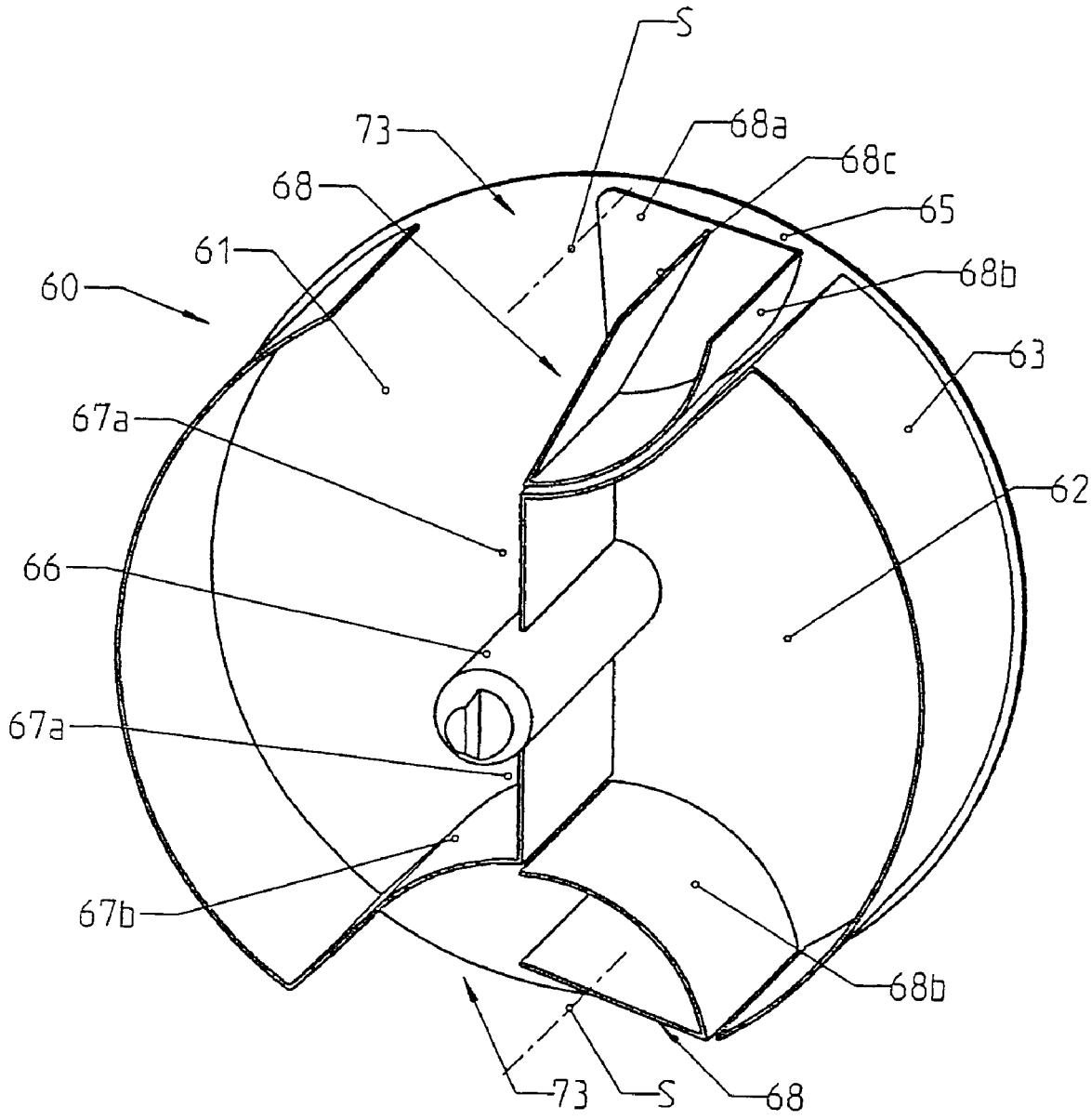
Figure 11:
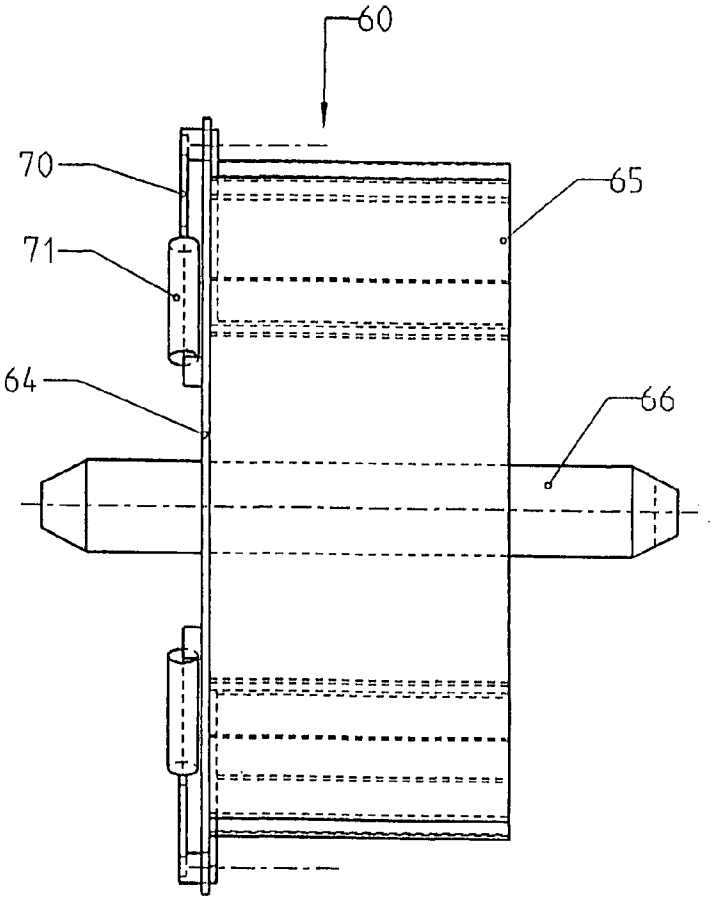
Figure 10:
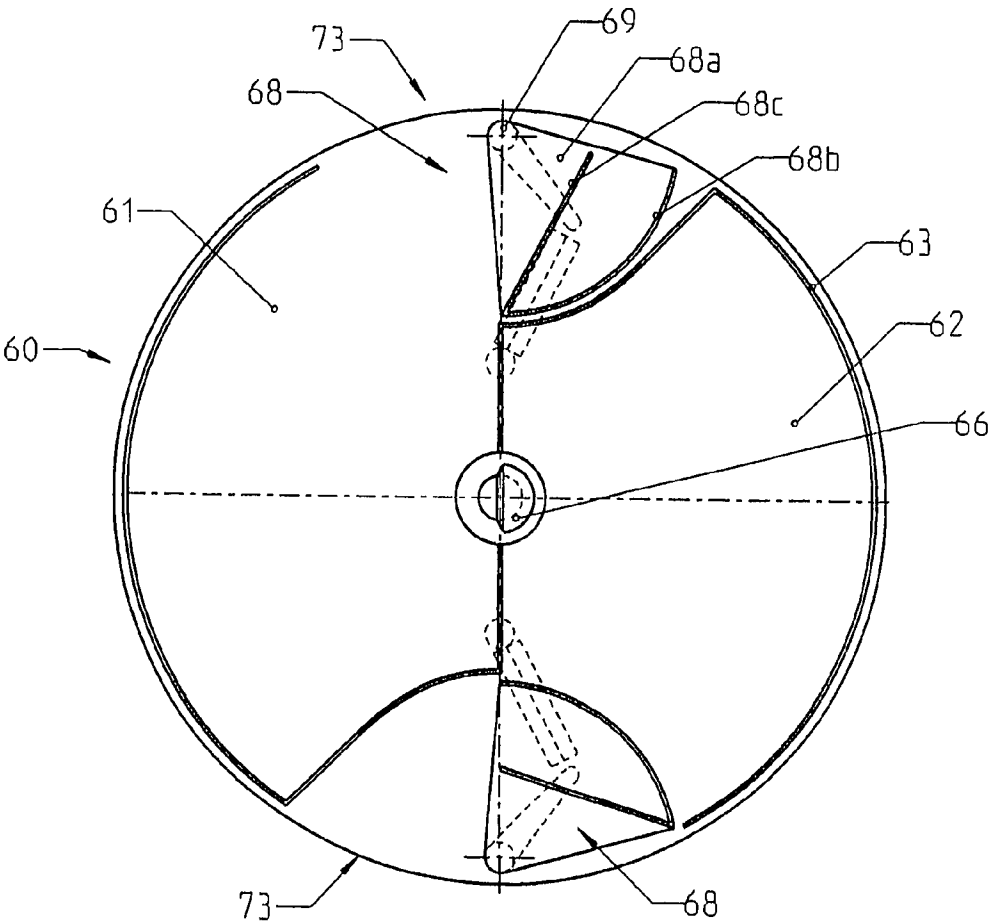
Figure 13:
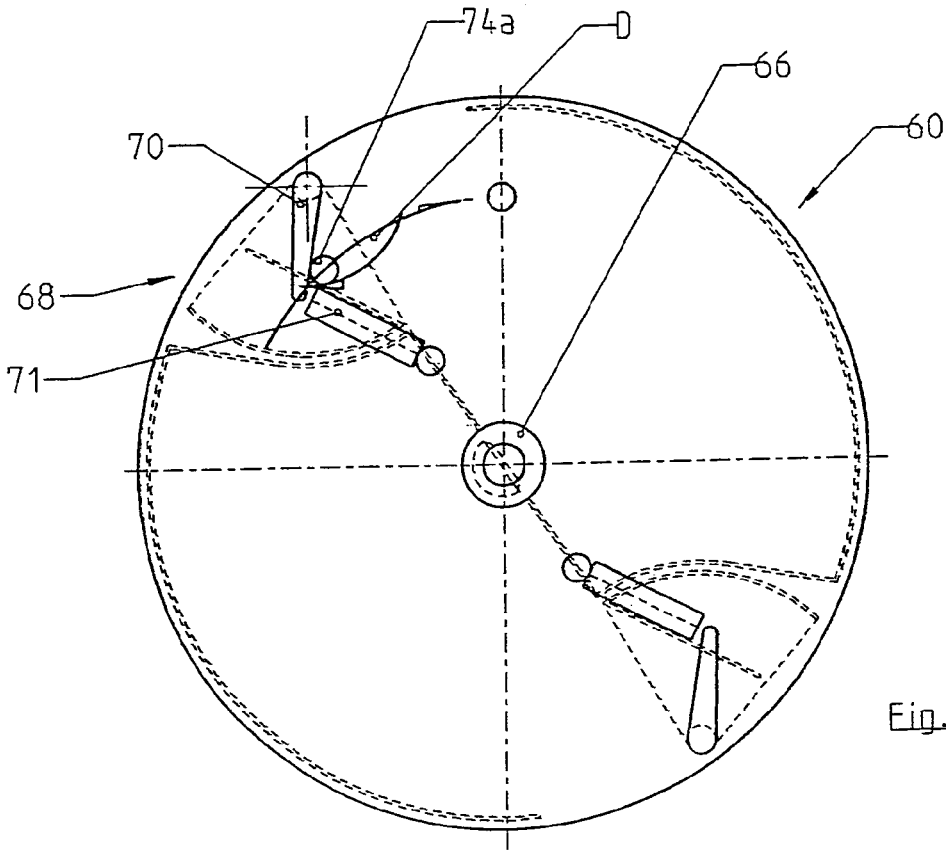
Figure 12:
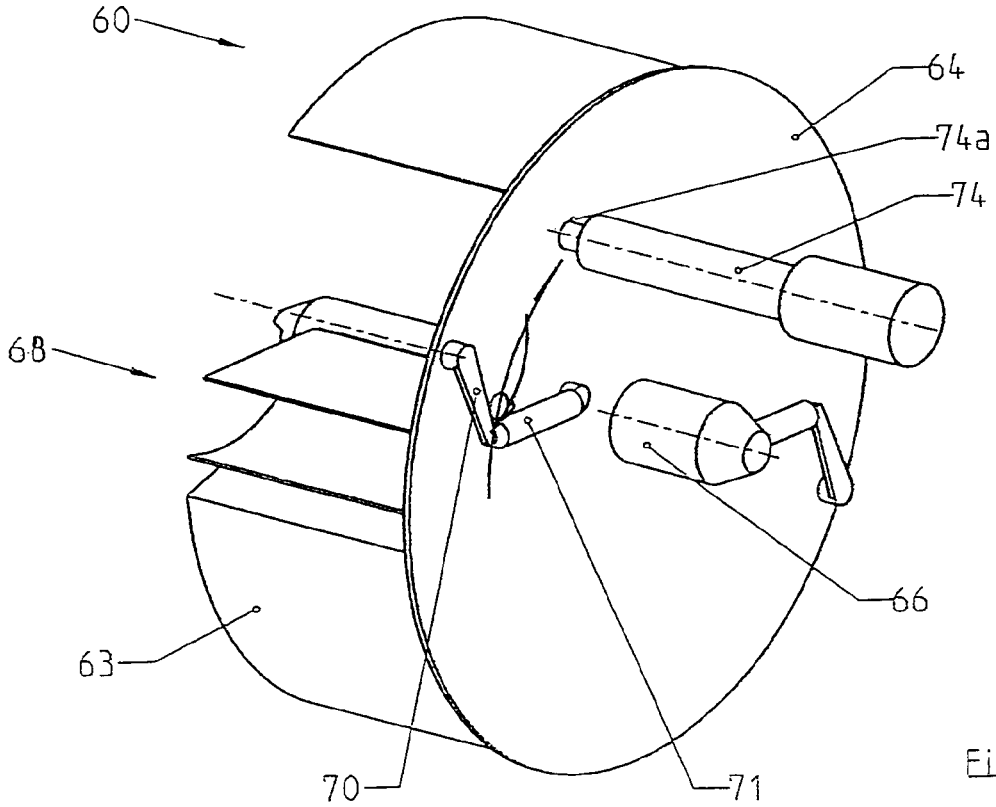

The lid 68—to be more precise, the circle-segment shaped sheet metal 68*a* of the lid 68—is/are connected fixed against rotation with the pivot axle 69, which is rotatable about the axis S shown in FIG. 8 in dash-dot lines. Pivot lever 70 is rigidly connected with this pivot axle 69, which is laid upon the outer side of the drum lid 64. Its free end is connected with one end of a pressure spring 71, which on the other end is connected with the bolt 72 of the drum lid 64. Pivot lever 70 and pressure spring 71 are provided in the manner of a bent lever or toggle lever, so that the pivot lever 70 and therewith the with it rigidly connected lid 68 are held in two positions, namely, the open and the closed position, as is more clearly understood from the representations in FIGS. 10, 12 and 13.

This simple bent lever arrangement makes possible a problem-free control of the lids. For this purpose there is basically needed a control slide (valve) 74, provided coaxial to the drive and transport axis 66, slideable against the drum lid 64 or, as the case may be, away from this. This control slider is provided and controllable in such manner, that its outer located bolt 74*a* lies in the advanced position of the control slider 74 in the way of the free end of the pivot lever 70. During rotation of the drum 60 in the direction of the arrow D the pivot lever 70 runs up against or onto the bolt 74*a*, whereby the lid 68, on the basis of the rotation of the coating drum 60, is opened or, as the case may be, closed.

One essential advantage of the coating drum 60 designed in accordance with the invention is, besides the even or balanced filling of the drum chambers 61 and 62, the gentle filling or as the case may be emptying.

Figure 14:
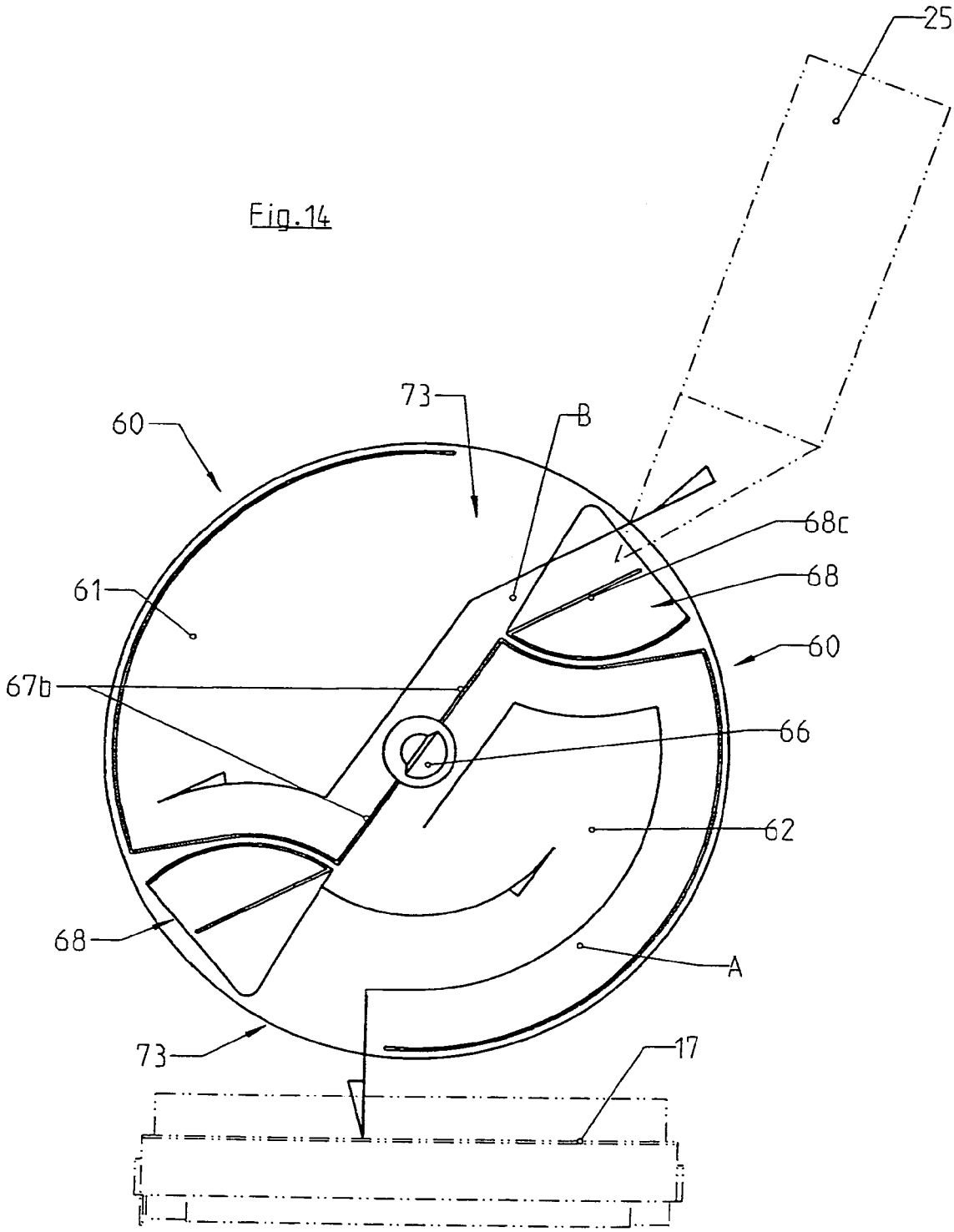

In FIG. 14 a coating drum 60 is shown, of which the drum chambers 61 can be filled with not shown small parts, which exist in the form of flowable material, via a filling chute 26 shown in dot-dash lines. The small parts located in the supply or fill chute 25 slide with the smallest possible drop height over the slide 68*c*, the lid 68, and along the diagonal section 67*b* of the separating wall 67 into the drum chamber 61. The path, which the small parts travel, is indicated with arrow B.

With the second chamber 62, of which the lid 68 is shown in open position, the emptying process is shown. Therein small parts located in the drum chamber 62 flow along arrow A through the lower-lying chamber opening 73 onto the dash-dot line indicated pallet 17.

Both the filling as well as the emptying steps subject the small parts to relatively small drop heights, which is extraordinarily important for the gentle handling of small parts which exist in the form of flowable material.

REFERENCE NUMBER LIST

10 Single drum coating facility
11 Machine stand
12 Coating drum, during filling or emptying
12' Coating drum, during coating or centrifuging
13 Housing
14 Spray cover
15 Drum transport pusher
16 Coating basin
17 Pallet
18 Pallet transporter
19 Drive
20 Drive
21 Press device
22 Press device
23 Supply container
24 Connecting hose
25 Coating chute
26 Coating chute
27 Carriage and guide rail
40 Multi-drum circulating coating facility
41*a–n* Coating drums
42 Coating basin
43 Drip sink
44 Lower spray cover
45 Upper spray cover
46 Pallet
47 Pallet transporter
48 Coating chute
49 Carriage and guide rail
50 Supply container
51 Connecting hoses
60 Coating drum
61 First drum chamber
62 Second drum chamber

63 Drum casing
64 Drum lid
65 Drum lid
66 Drive and transport axle
67 Separating wall
67*a* Diagonal segment of the separating wall
67*b* Bow shape segment of the separating wall
68 Lid
68*a* Circle-segment shaped sheet metal
68*b* Curved segment of the lid
68*c* Slide
69 Pivot axes
70 Pivot lever
71 Pressure spring
72 Spring mount
73 Openings
74 Control slide (valve)

The invention claimed is:

1. A drum coating facility (10) for surface coating of small parts, comprising:

at least one coating drum with partially perforated wall and at least one closeable fill-and-emptying opening (73) as well as a rotational drive means, further comprised of a fill-and-emptying station, a coating station with a coating basin (16) in which the coating drum can be dipped and a transport device for transport of the coating drum from the fill-and-emptying station to the coating station, wherein the coating drum is comprised of a hollow cylinder with drum casing (63), drum lids (64, 65) on both sides and a horizontally oriented drive and transport axle (66), which coating drum (60) is segregated into two identically-dimensioned, rotationally-symmetric drum chambers (61, 62) via a separating wall (67) running along the diagonal, that the drum casing (63) has openings (73) arranged to lie opposite to each other symmetrically about the drive and transport axle (66), which are respectively closeable by means of a lid (68) located pivotably between the drum lids (64, 65).

2. The device according to claim 1, wherein the separating wall (67) is comprised of two radial segments (67*a*) lying diametrically opposed to each other on opposite sides of the drive and transport axle (66) and thereto connected curved segments (67*b*) extending from the radial segments (67*a*) to the drum casing (63), the lid (68) respectively include a curved segment (68*b*) corresponding to the curved segment (67*b*) of the separating wall (67) mirror-symmetrically to the radial segment (67*a*), which in the open position of the lid (68) lies against an outer side of the curved segment (67*b*) of the separating wall (67) and in the closed position of the lid (68) closes the opening (73) of the coating drum.

3. The device according to claim 2, wherein the curved segment (68*b*) of the lid (68) is carried on both sides by two circle-segment shaped pieces of sheet metal (68*a*), which are mounted pivotable on the drum lids (64, 65), wherein a pivot axis (69) of the lid (68) runs parallel to the drive and transport axle (66) and close to an outer circumference of the coating drum.

4. The device according to claim 3, wherein the lid pivot axle (69) is connected to and fixed against rotation with the lid (68), a pivot lever (70) is connected to and fixed against rotation with the pivot axle (69), which pivot lever (70) lies on the outside of the drum lid (64), and the pivot lever (70) is provided with an advance slideable control pusher (74), whereby the lid (68) upon rotation of the coating drum in one direction is opened and upon rotation in the opposite direction is closed.

5. The device according to claim 4, wherein the free end of the pivot lever (70) is associated with a pressure spring (71), of which the other end is secured to the outer side of the drum lid (64), wherein the pivot lever (70) and pressure spring (71) are provided in the manner of a bent lever or toggle switch.

6. The device according to claim 1, wherein the lid (68) is provided with a slide (68*c*) extending over its breadth for the guidance of the small parts to be filled or emptied.

7. The device according to claim 1, wherein a filling and metering device is provided above the opening (73) of the coating drum, which device is comprised of at least two supply chutes (25; 26) slideable upon a carriage and guidance rail (27) parallel to the drive and transport axle (66), with which proportioned amounts of small parts are fillable into the drum chambers (61, 62).

8. The device according to claim 7, wherein the filling and metering device is associated with a weighing-and-fill station, with which the two supply chutes (25, 26) are filled with precisely metered, equal amounts of small parts.

9. The device according to claim 1, wherein the transport device is comprised of a drum transport pusher (15) and the coating drum is moveable out of the fill-and-emptying station and into the coating station via the drum transport pusher (15), in which the coating basin (16) raisable against the coating drum is provided.

10. The device according to claim 9, wherein both in the fill-and-emptying station as well as in the coating station respectively one coupleable drive means (20, 22; 19, 21) is provided for the coating drum.

11. The device according to claim 9, wherein a spray cover (14) is provided and is located in the coating station above the coating drum.

12. The device according to claim 9, wherein below the coating drum located in the filling-and-emptying station a pallet (17) is provided for receiving the coated small parts, which is transportable to an oven by means of a pallet transporter (18).

13. The device according to claim 9, wherein the coating basin (16) is associated with a supply container (23).

14. The device according to claim 1, wherein the coating drum includes a plurality of coating drums, which by means of the transporter device are transportable to stations selected from the group consisting of the fill-and-emptying station, the coating station, a drip station and a spin station.

15. The device according to claim 14, wherein the transporter device returns emptied drums.

* * * * *